US005611396A

United States Patent [19]

Reed

[11] Patent Number: 5,611,396

[45] Date of Patent: Mar. 18, 1997

[54] METHOD AND APPARATUS FOR THROTTLE VALVE CONTROL OF A CALENDER ROLL ACTUATOR

[75] Inventor: Gordon K. Reed, Bexley, Ohio

[73] Assignee: ABB Industrial Systems, Inc., Columbus, Ohio

[21] Appl. No.: 293,396

[22] Filed: Aug. 19, 1994

[51] Int. Cl.[6] ..... B60H 1/00

[52] U.S. Cl. ..... 165/300; 100/329; 100/333; 100/328

[58] Field of Search ..... 165/40, 89; 100/93 RP, 100/74, 73

[56] References Cited

U.S. PATENT DOCUMENTS

| | | | |
|---|---|---|---|
| 737,571 | 9/1903 | Bray | 100/93 RP |
| 2,566,943 | 9/1951 | King | 100/74 |
| 2,981,175 | 4/1961 | Goyette . | |
| 3,177,799 | 4/1965 | Justus et al. . | |
| 3,203,678 | 8/1965 | Sawyer et al. . | |
| 3,352,232 | 11/1967 | Leibelt . | |
| 3,770,578 | 11/1973 | Spurrell . | |
| 3,993,124 | 11/1976 | Mueller | 165/89 |
| 4,114,528 | 9/1978 | Walker . | |
| 4,573,402 | 3/1986 | Sharma et al. . | |
| 4,738,196 | 4/1988 | Boissevain . | |
| 4,748,906 | 6/1988 | Ashmore | 100/93 RP |
| 4,768,433 | 9/1988 | Boissevain . | |
| 4,984,622 | 1/1991 | Reed . | |
| 5,106,655 | 4/1992 | Boissevain et al. . | |
| 5,289,766 | 3/1994 | Conrad et al. . | |

FOREIGN PATENT DOCUMENTS

| | | | |
|---|---|---|---|
| 0695194 | 9/1964 | Canada | 100/93 RP |
| 0475284 | 11/1937 | United Kingdom | 100/74 |

*Primary Examiner*—Edward K. Look
*Assistant Examiner*—Mark Sgantzos
*Attorney, Agent, or Firm*—Killworth, Gottman, Hagan & Schaeff

[57] ABSTRACT

A throttle valve is provided in each actuator of a calender roll controller with the throttle valve controlling an internal air orifice within each actuator to provide a substantially uniform air mass flow of either hot or cold air. Each throttle valve is controlled in response to the temperature of the air being delivered by the actuator such that a smaller orifice is provided for hot air than for cold air to provide substantially uniform air mass flow from each of the actuators and therefore substantially uniform air velocity to better control the temperatures of the longitudinal zones of a calender roll and better maintain boundaries between the zones. In addition to throttle valve control of the actuators, an air scoop concentric with a calender roll being controlled and spaced from the calender roll is provided to channel air from the actuators over the calender roll. The scoop comprises heat insulating material to prevent heat loss out the back of the scoop. In addition, a plurality of arcuate zone strips are provided on the concave inner surface of the scoop and in substantial alignment with the plurality of actuators for channeling air from the actuators. The arcuate zone strips are spaced apart from one another for thermal separation such that thermal diffusion among longitudinal zones of a calender roll within the scoop are substantially eliminated.

23 Claims, 6 Drawing Sheets

METHOD AND APPARATUS FOR THROTTLE VALVE CONTROL OF A CALENDER ROLL ACTUATOR

BACKGROUND OF THE INVENTION

The present invention relates in general to processing webs of paper, plastics and other materials with calender rolls and, more particularly, to a method and apparatus for controlling one or more calender rolls to control characteristics of such webs. The present invention is initially being applied to the manufacture of webs of paper and, accordingly, will be described herein with reference to this application.

In manufacturing webs of material, such as paper, a variety of characteristics of the web can be controlled by passing the web through a nip formed between two cooperating pressing surfaces, such as counter-rotating pressure rolls or calender rolls. For example, the caliper, density and surface characteristics of a web of paper can be controlled by means of passing the web through calender rolls. To make the web caliper uniform across its width or in the cross-machine direction, the diameters at consecutive longitudinal zones along one or more of the calender rolls are controlled. The rolls are typically constructed of a material having positive thermal expansion such that the rolls expand when heated and contract when cooled. The diameters of calender rolls are then controlled by individually heating and cooling the longitudinal zones along the rolls.

A variety of actuator control arrangements have been used in calender rolls. In one instance, induction heating has been applied for rapidly heating longitudinal zones of a calender roll; however, cooling with this arrangement tends to be slow. More conventionally, conditioned air has been directed against longitudinal zones of a calender roll. Hot or cold air or mixtures of hot and cold air have been blown onto the longitudinal zones of calender rolls to control their diameters.

In U.S. Pat. No. 4,984,622, which issued to Reed, the hot and cold air is blown through a flow passageway which extends circumferentially around a calender roll and is defined by an arcuate scoop which is concentric with the roll. When hot and cold air are thus blown separately onto a calender roll at constant pressure, the air velocities are different due to the differing densities of hot and cold air. The differing air velocities cause air turbulence at the boundaries between the longitudinal zones such that the air flow in each zone affects the zones on both of its sides. This widens the effect of each zone on the calender roll and reduces the magnitude of the effect near the center of each zone. Thus, while Reed is an effective control for calender rolls, ideally, the boundaries between the zones should be crisp with little turbulence to increase the control at each zone and reduce the interference between zones.

While attempts have been made to provide constant volume air flow in calender roll actuators, for example by air mixing, problems remain in existing calender roll actuators. Accordingly, a need remains for an improved actuator and actuator control arrangement for calender rolls. Preferably, this arrangement would substantially equalize the velocities of air which flows circumferentially across calender rolls by raising the cooling air velocity to match the typically higher hot air velocity to improve heat transfer during cooling as well as narrow the effective widths of the longitudinal control zones along calender rolls.

SUMMARY OF THE INVENTION

This need is met by the method and apparatus of the present invention wherein a throttle valve is provided in each of a plurality of actuators which extend across a roll of a calender having one or more rolls. A throttle valve controls an internal air orifice within each actuator to provide a substantially uniform air mass flow whether the air is hot or cold. Each throttle valve is controlled in response to the temperature of the air being delivered by the actuator such that a smaller orifice is provided for hot air than for cold air. By providing a substantially uniform air mass flow from each of the actuators, the actuators provide substantially uniform air velocity to better control the temperatures of the longitudinal zones of a calender roll and better maintain boundaries between the zones.

The throttle valves work to close or reduce the size of the internal orifices within the actuators for hot air and open or increase the size of the internal orifices for cold air. Compared to a constant orifice actuator, the throttle valves provide an increased orifice for cold air such that cold air velocity from the actuators is increased to improve heat transfer during cooling.

The improved cooling in effect extends the range of control of a calender being controlled by actuators of the present application at the bottom of the control range or on the cooling side. This increase is at a minimal cost of providing sufficient blower power to move cold air through the actuators at an increased velocity but with no increase in power provided to heaters of the actuators. Accordingly, since operation of the actuators is commonly maintained near a 50% set-point and the range of control is extended, the average power consumption for the actuators is reduced.

In addition to throttle valve control of the actuators of the present application, an air scoop concentric with a calender roll being controlled and spaced from the calender roll is provided to channel air from the actuators over the calender roll. In the past, such scoops have been made of metal such that heat is conducted through the scoops to be lost out the back of the scoops. Also, the scoop can contribute to the blurring of boundaries between longitudinal zones of the calender roll since heat is absorbed by the scoop and transmitted through the scoop among the longitudinal zones of the calender roll.

In the invention of the present application, a scoop is provided which comprises heat insulating material to prevent the loss of heat out the back of the scoop. In addition, a plurality of arcuate zone strips are provided on the concave inner surface of the scoop and in substantial alignment with the plurality of actuators for channeling air from the actuators. The arcuate zone strips are spaced apart from one another for thermal separation such that thermal diffusion among longitudinal zones of a calender roll within the scoop are substantially eliminated.

In accordance with one aspect of the present invention, an actuator for controlling one longitudinal zone of a calender roll, the actuator being connected between a pressurized air plenum and the one longitudinal zone which is to be controlled by the actuator, comprises an air conducting housing having a proximal end connected to and in communication with the plenum for receiving air from the plenum and a distal end for discharging air from an air outlet of the housing at the one longitudinal zone. A heater is connected within the housing for passing air from the proximal end of the housing toward the distal end of the housing. A valve is connected within the housing for controlling the volume of air discharged at the one longitudinal zone in response to air temperature being discharged. While the valve can be connected anywhere within the housing, even incorporated into the heater, preferably the valve is connected within the housing between the heater and the distal end of the housing such that it can be directly controlled by the air coming from the heater.

In the illustrated embodiment, the distal end of the housing comprises a discharge nozzle having an inlet opening and an outlet opening. The valve is connected to control the size of the inlet opening of the discharge nozzle. The valve may comprise a thermostatic metal panel which is secured within the housing between the heater and the distal end of the housing for movement between a first position wherein the inlet opening of the discharge nozzle is substantially open and a second position wherein the inlet opening of the discharge nozzle is substantially closed. The panel is spaced from inside walls of the housing by a selected distance to define an air orifice within the housing when the inlet opening of the discharge nozzle is substantially closed.

Alternately, the panel may be sized relative to the housing such that sufficient spacing is defined between the panel and inside walls of the housing to permit free movement of the panel within the housing. For this embodiment, at least one aperture is provided through the panel with the at least one aperture and the spacing between the panel and the inside walls of the housing defining an air orifice within the housing when the inlet opening of the discharge nozzle is substantially closed.

To reduce energy usage by the actuator, the heater and the panel are selected such that the inlet opening of the discharge nozzle is substantially closed with less than 50% of maximum power provided to the heater. It is currently preferred to select the heater and the panel such that the inlet opening of the discharge nozzle is substantially closed with 30% or more of maximum power provided to the heater.

In a second embodiment, the heater defines a first passage between the proximal end and the distal end of the housing and the housing comprises a second passage around the heater between the proximal end and the distal end of the housing. The second passage includes a divider plate coupled to the inlet opening of the nozzle for continuously passing air from the second passage to the nozzle. The valve then controls the volume of air passing from the proximal end of the housing through the heater to the nozzle. For this embodiment, the valve comprises a thermostatic metal panel which is secured within the housing for movement on a first side of the divider plate within the second passage. A valve panel is secured within the housing for movement on a second side of the divider plate between a first position wherein the inlet opening of the discharge nozzle is substantially open and a second position wherein the inlet opening of the discharge nozzle is substantially closed. At least one link element is connected between the thermostatic metal panel and the valve panel through at least one aperture in the divider plate such that movement of the valve panel is controlled by movement of the thermostatic metal panel. The at least one aperture in the divider plate defines a portion of the second passage.

To reduce energy usage by the actuator, the heater and the panel are selected such that the inlet opening of the discharge nozzle is substantially closed with less than 50% of maximum power provided to the heater. It is currently preferred to select the heater and the panel such that the inlet opening of the discharge nozzle is substantially closed with 30% or more of maximum power provided to the heater.

In accordance with another aspect of the present invention, a controller for a calender roll with a plurality of longitudinal zones therealong comprises a plurality of actuators corresponding to the plurality of longitudinal zones and being connected between a pressurized plenum and the calender roll. Each of the actuators comprises an air conducting housing having a proximal end connected to and in communication with the plenum for receiving air from the plenum and a distal end for discharging air from an air outlet of the housing. A heater is connected within the housing for passing air from the proximal end of the housing toward the distal end of the housing. A valve is connected within the housing for controlling the volume of air discharged at the air outlet in response to air temperature being discharged. An arcuate scoop extends from the distal ends of the plurality of actuators and is positioned adjacent and spaced from the calender roll and substantially concentric therewith for defining an arcuate channel for receiving air from the air outlets of the plurality of actuators.

The arcuate scoop has an inner face adjacent the calender roll and an outer face. To prevent heat from escaping out the back, convex side of the scoop, the scoop comprises heat insulating material to insulate the inner face from the outer face. The insulating material of the arcuate scoop comprises an inner face layer thereof. The scoop further comprises a plurality of arcuate zone strips corresponding to the plurality of longitudinal zones and being substantially aligned with the plurality of actuators. The plurality of arcuate zone strips are formed of metal bands which are secured to the inner face layer and insulated from one another for conducting air from the plurality of actuators along the scoop with reduced thermal coupling between individual ones of the zone strips and between the zone strips and the outer face.

The valve preferably is connected into the housing between the heater and the distal end of the housing. The distal end of the housing of each of the plurality of actuators comprises a discharge nozzle having an inlet opening and an outlet opening, and the valve of each of the plurality of actuators is connected to control the size of the inlet opening of the discharge nozzle. While a variety of valves can be used, it is currently preferred to construct the valve of each of the plurality of actuators as a thermostatic metal panel which is secured within the housing for movement between a first position wherein the inlet opening of the discharge nozzle is substantially open and a second position wherein the inlet opening of the discharge nozzle is substantially closed.

In accordance with yet another aspect of the present invention, a method for controlling an actuator for one longitudinal zone of a calender roll comprises the steps of: providing a source of pressurized air; coupling an actuator to the source of pressurized air; passing air from the pressurized source through a heater; operating the heater to control air temperature; directing air from the heater through a discharge nozzle onto the one longitudinal zone of the calender roll; and, controlling the volume of air discharged through the discharge nozzle in response to air temperature being discharged.

The step of controlling the volume of air discharged through the discharge nozzle may comprise the step of changing an air orifice defined by an inlet opening of the discharge nozzle in response to air temperature being discharged. In turn, the step of changing an air orifice defined by an inlet opening of the discharge nozzle in response to air temperature being discharged may comprise the step of providing a thermostat metal panel which responds to air temperature by closing the inlet opening of the discharge nozzle as air temperature increases and by opening the inlet opening of the discharge nozzle as air temperature increases.

The step of changing an air orifice defined by an inlet opening of the discharge nozzle in response to air temperature being discharged preferably comprises the step of substantially closing the inlet opening at operating levels of the heater less than 50% maximum heating power to reduce average power consumed by the actuator. Preferably, the step of changing an air orifice defined by an inlet opening of the discharge nozzle in response to air temperature being discharged comprises the step of substantially closing the inlet opening at operating levels of the heater of approximately 30% or more of maximum heating power.

It is thus an object of the present invention to provide an improved method and apparatus for controlling one or more calender rolls to control characteristics of webs of material passing through the calender; to provide an improved method and apparatus for controlling one or more calender rolls by utilizing throttle valves in a plurality of actuators extending across the calender rolls such that a substantially constant air mass flow is emitted from each actuator; and, to provide an improved method and apparatus for controlling one or more calender rolls by utilizing throttle valves in a plurality of actuators extending across the calender rolls such that a substantially constant air mass flow is emitted from each actuator with an insulated scoop having a plurality of zone strips corresponding to the actuators and separated from one another to reduce heat diffusion among longitudinal zones of the calender rolls.

Other objects and advantages of the invention will be apparent from the following description, the accompanying drawings and the appended claims.

DETAILED DESCRIPTION OF THE INVENTION

Figure 1:
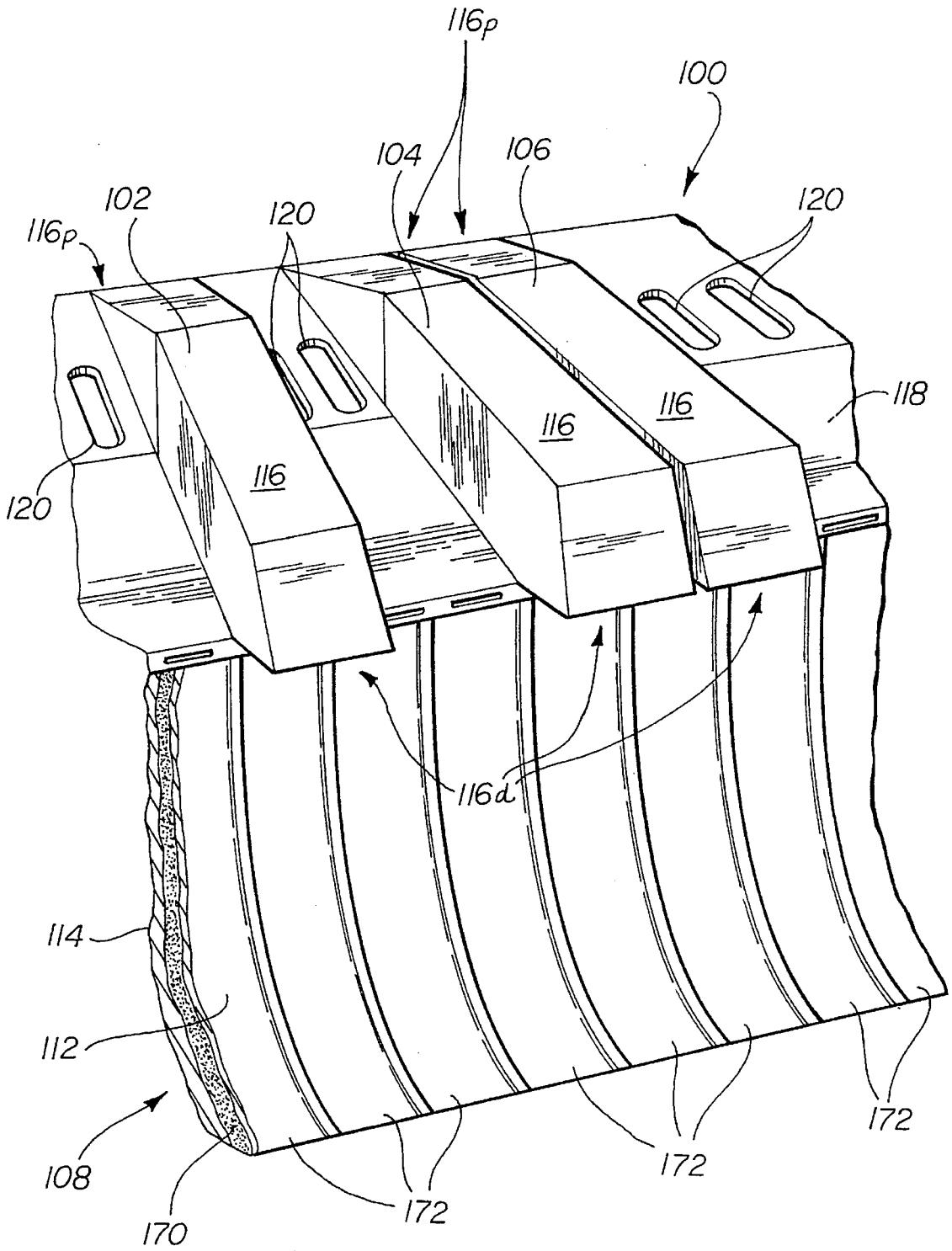
FIG. 1 is a perspective view of three actuators and a section of an insulated scoop operable in accordance with the present invention to control a calender roll.

Reference will now be made to the drawing figures wherein FIG. 1 is perspective view of a section of a controller 100 for a calender roll 101 shown in FIGS. 2 and 3. Three substantially identical actuators 102, 104, 106 and a section of an insulated arcuate scoop 108 operable in accordance with the present invention to control the calender roll 101 are illustrated in FIG. 1. Actuators across the calender roll 101, including the illustrated actuators 102, 104, 106, define longitudinal zones along the calender roll 101 and are readily connected to and removed from the controller 100 by means of a tongue T and a tab t, see FIGS. 2–4. The scoop 108 is substantially concentrically aligned with the calender roll 101 and spaced therefrom to define an arcuate channel 110 for receiving air from air outlets 111 of the actuators, including the actuators 102, 104, 106. The scoop 108 includes a generally concave inner face 112 adjacent the calender roll 101 and a generally convex outer face 114 directed away from the calender roll 101.

While a variety of actuator widths, for example from approximately 2 to 4 inches (50 to 100 mm), may be used in calender roll controllers, actuators used to control the calender roll 101 in a working embodiment of the present invention are approximately 3 inches (75 mm) in width such that a large number of actuators are used in a controller for a wide calender roll. However, since all of the actuators across the calender roll 101 are substantially identical to one another, only one of the actuators 104 will be described herein.

Figure 2:
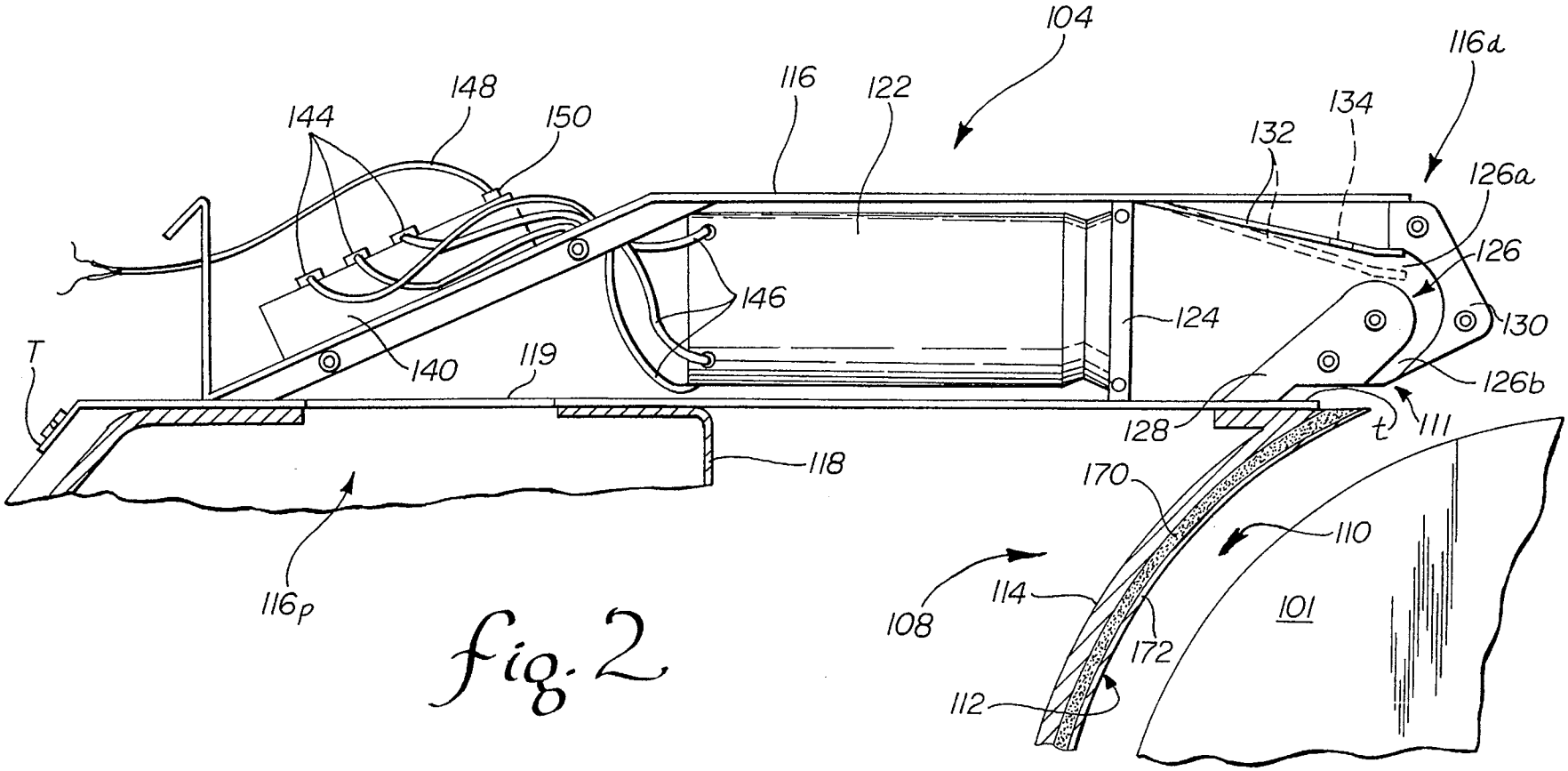
FIG. 2 is a side view of a first embodiment of an actuator of FIG. 1 having a side panel removed and showing an associated plenum and scoop in section.
Figure 3:
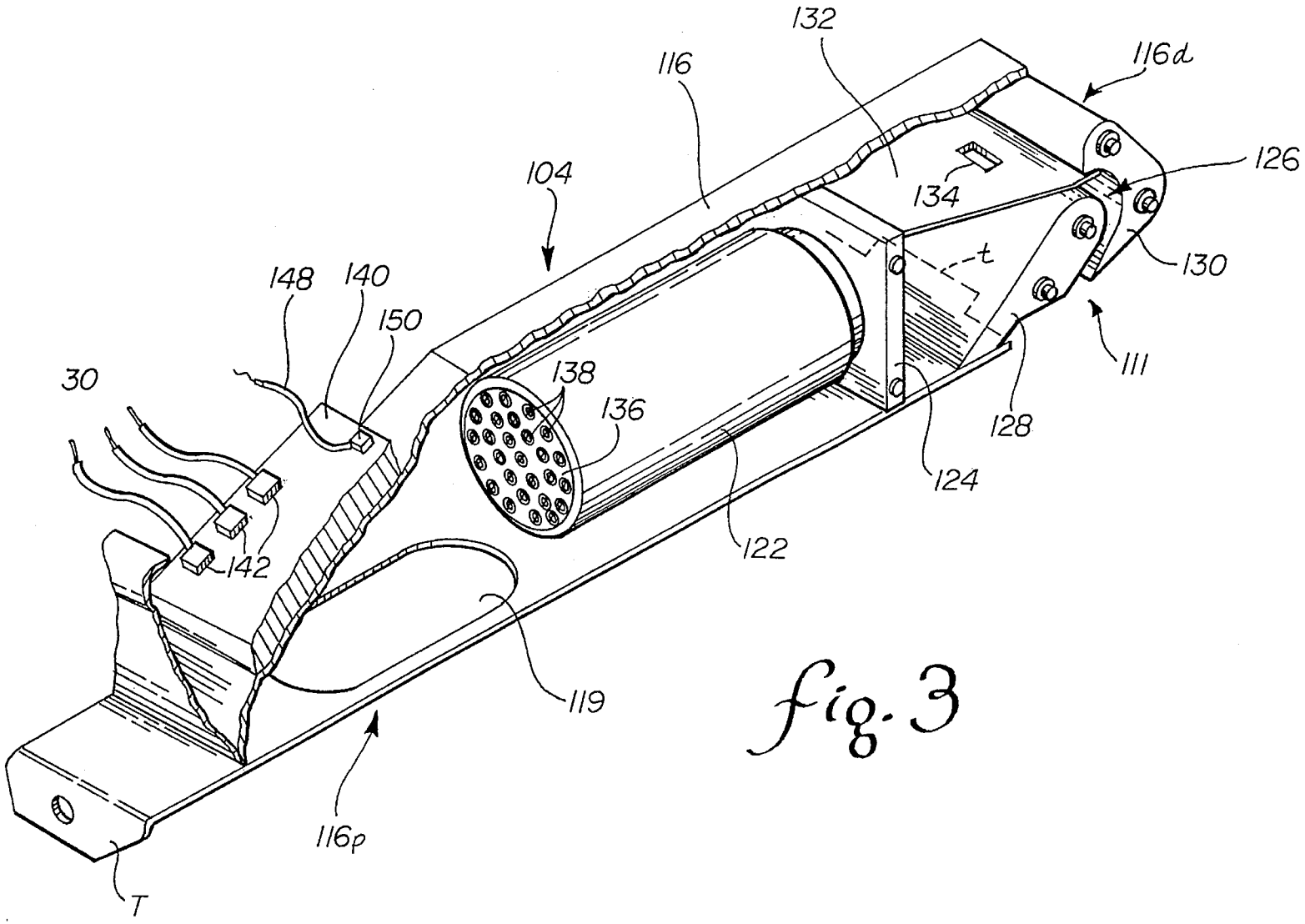
FIG. 3 is a perspective view of the actuator of FIG. 2 having a portion of the actuator broken-away.

A first embodiment of the actuator 104 is illustrated in side view in FIG. 2 with a side cover removed to reveal the internal structure of the actuator 104. The actuator 104 comprises an air conducting housing 116. The housing 116 has a proximal end **116*p* connected to and in communication with a pressurized air plenum 118 for receiving air from the plenum 118 through generally oblong openings 120 formed in an upper surface of the plenum 118 and corresponding generally oblong openings 119 formed in the bottom of the proximal end 116*p* of the housing 116. The housing 116 also has a distal end 116*d* for discharging air from the air outlet 111 of the housing 116 at one of the longitudinal zones across the calender roll 101 corresponding to the actuator 104**.

A heater 122 is mounted for cantilever support onto an insulating ceramic plate 124 having a large central aperture sized to permit substantially unrestricted air flow through the heater 122. The heater 122 passes air through the housing 116 from the proximal end **116*p* toward the distal end 116*d*. A valve is connected within the housing 116 for controlling the volume of air discharged at the air outlet 111** to the corresponding longitudinal zone in response to air temperature being discharged.

While the valve can be located within the proximal end **116*p* of the housing 116, within the distal end of the housing 116*d* or even incorporated into the heater 116, in the currently preferred form of the invention, the valve is located between the heater 116 and the distal end 116*d* of the housing 116. This positioning permits the valve to be directly and passively operated in response to the temperature of the air passing from the actuator 104. While the valve could be controlled by a valve driver, for example a direct controller which would position the valve to a desired open/close position, such additional control adds to the complexity and cost of the actuator 104**. Other positions of the valve may require a valve driver although indirect thermal control arrangements, even though more complex than what will next be described, can be envisioned by those skilled in the art.

The housing 116 comprises a discharge nozzle 126 defined between a ceramic arch 128 and a curvilinear nose piece 130 with the discharge nozzle 126 having an inlet opening **126*a* and an outlet opening 126*b* which defines the air outlet 111. In the illustrated and currently preferred embodiment of FIGS. 2 and 3, the valve comprises a thermostatic metal panel 132 which is connected to control the size of the inlet opening 126*a* of the discharge nozzle 126. Thermostatic metal panel as used herein should be understood to mean that the panel is made of bimetallic material for which the American Society for Testing and Materials (ASTM) has adopted the designation thermostat metal. In the embodiment illustrated in FIGS. 2 and 3, The thermostatic metal panel 132 is secured within the housing 116 by the ceramic plate 124 for movement between a first position shown in solid line drawing in FIG. 2 wherein the inlet opening 126***a* of the discharge nozzle 126 is substantially open and a second position shown in dotted line drawing in FIG. 2 wherein the inlet opening 126*a* of the discharge nozzle 126 is substantially closed.

Even though the inlet opening 126*a* of the discharge nozzle 126 is substantially closed by the panel 132 as shown in the dotted line drawing of FIG. 2, an air orifice is still defined at the inlet opening 126*a* of the discharge nozzle 126. The air orifice is defined, for example, by selecting the spacing between the panel 132 and the inside walls of the housing 116. Alternately, the panel 132 may be sized relative to the inside walls of the housing 116 such that sufficient spacing is defined between the panel 132 and the inside walls of the housing 116 to permit free movement of the panel 132 within the housing 116, but no more. If this spacing is insufficient to define an appropriate air orifice, then at least one aperture, such as the aperture 134, can be provided through the panel 132. Then, the air orifice for the closed position of the panel 132 is defined by the spacing between the panel 132 and the inside walls of the housing 116 plus the aperture 134.

In a working embodiment of the invention, the heater 122 is a 5 kilowatt heater made by Farnam Custom Products. The heater 122 is operated by three phase power and includes a cylindrical ceramic insert 136 having thirty seven (37) bores 138 each having a nichrome resistance heater inserted thereinto and extending therethrough. Of course, other single or multiple phase heaters can be used in the present invention.

The heater 122 is controlled-by a conventional three phase silicon controlled rectifier (SCR) switch 140 which receives three phase power on inputs 142, delivers three phase power to the heater 122 via outputs 144 and interconnecting wires 146, and receives switch control signals via wires 148 and control inputs 150. Control may be performed by passing a selected number of half cycles of power in synchronism with zero crossing points of the current of the input power waveform or in any other appropriate manner such that power to the heater 122 can be controlled between 0% and 100% of the power of the heater 122. Thus, control of the heater 122 can be continuous, stepped, etc.

Figure 4:
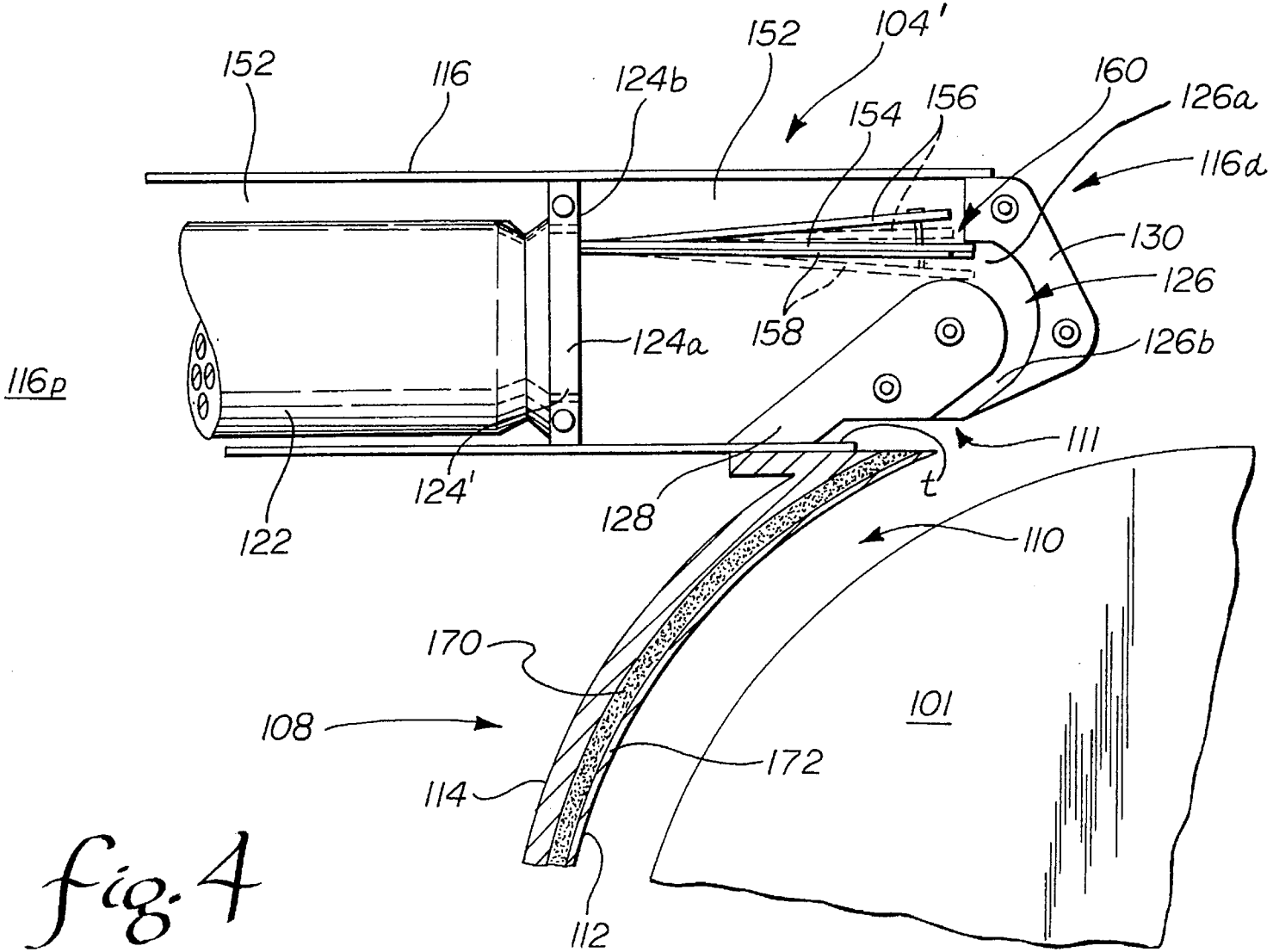
FIG. 4 is a portion of an actuator illustrating a second embodiment of an actuator operable in accordance with the present invention.
Figure 6:
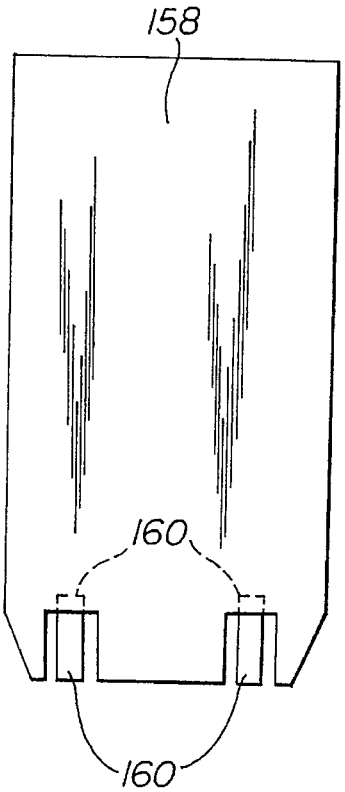
FIGS. 6, 7 and 8 show in plan view the valve panel, divider plate and thermostatic metal panel, respectively.
Figure 7:
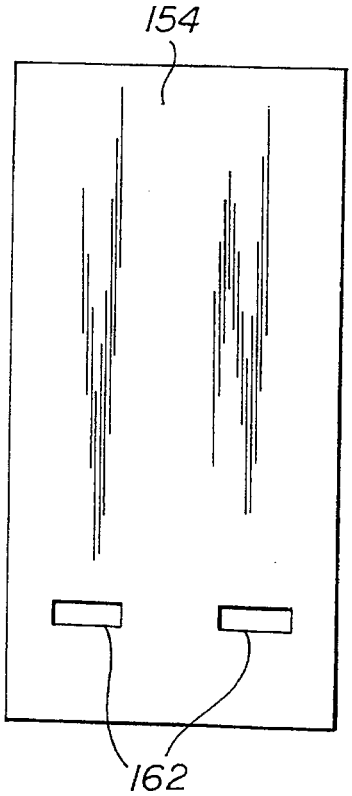
Figure 8:
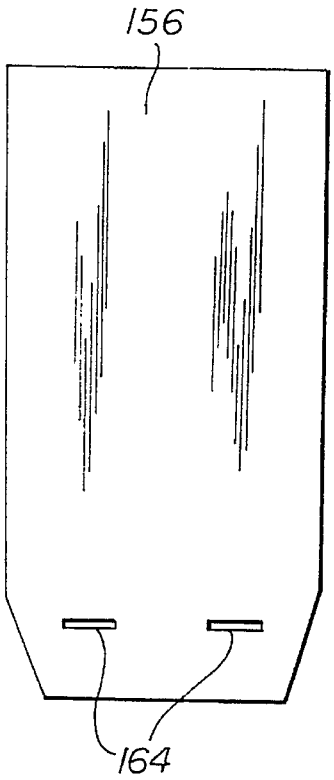

A portion of a second embodiment of an actuator 104' is illustrated in FIG. 4. In this embodiment, the heater 122 defines a first passage between the proximal end 116*p* and the distal end 116*d* of the housing 116. The heater 122 is mounted for cantilever support onto an insulating ceramic plate 124' having a first large aperture 124*a* in the lower portion of the plate 124' sized to permit substantially unrestricted air flow through the heater 122. The housing 116 defines a second passage 152 around the heater 122 between the proximal end 116*p* and the distal end 116*d* of the housing 116 with a second small aperture 124*b* defining a portion of the second passage 152. The second passage 152 includes a divider plate 154 coupled to the inlet opening 126*a* of the nozzle 126 for continuously passing air from the second passage 152 to the nozzle 126 with a valve controlling the volume of air passing from the proximal end 116*a*, through the heater 122 to the nozzle 126.

For the second embodiment of FIG. 4, the valve comprises a thermostatic metal panel 156 which is secured within the housing 116 for movement on a first side of the divider plate 154, the top side in the illustrated embodiment, within the second passage 152. Also see FIGS. 5–8. A valve panel 158 is secured within the housing 116 for movement on a second side of the divider plate 154, the bottom side in the illustrated embodiment, between a first position wherein the inlet opening 126*a* of the discharge nozzle 126 is substantially open, illustrated in solid line drawing in FIG. 4, and a second position wherein the inlet opening 126*a* of the discharge nozzle 126 is substantially closed, illustrated in dotted line drawing in FIG. 4. At least one link element 160 is connected between the thermostatic metal panel 156 and the valve panel 158 through at least one aperture in the divider plate 154 such that movement of the valve panel 158 is controlled by movement of the thermostatic metal panel 156.

Figure 5:
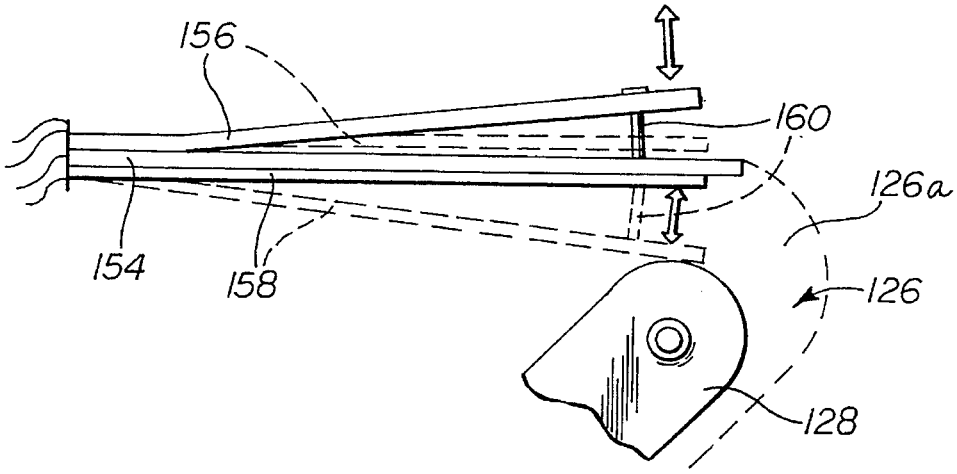
FIG. 5 shows, on an enlarged scale, a valve of the second actuator embodiment of FIG. 4 which includes a thermostatic metal panel on one side of a divider plate and a valve panel on the other side of the divider plate, with the thermostatic metal panel being connected to control the valve panel through the divider plate.

In the embodiment illustrated in FIGS. 4–8, two link elements 160 are formed from cutout portions of the valve panel 158. The link elements 160 are then bent at approximately 90 degrees, as shown by the dotted line drawings of FIG. 6, and passed through apertures 162 formed through the divider plate 154 to be secured within openings 164 formed in the thermostatic metal panel 156. Operation of the valve is illustrated in FIGS. 4 and 5. The excess size of the apertures 162 relative to the link elements 160 define an air orifice which passes approximately 10% cold air through the second passage 152 substantially independent of the position of the valve panel 158. However, the position of the valve panel 158 controls the air which flows through the heater 122. This embodiment provides a more linear operation for the actuator 104' illustrated in FIGS. 4–8.

Operation of the actuators 104 of the present application to reduce average power consumption will now be described. In the actuator 104 of FIGS. 2 and 3, three air orifices are defined within the housing 116. The first air orifice is defined by the heater 122, the second air orifice is defined by the valved opening of the inlet opening 126*a* of the discharge nozzle 126, and the third air orifice is defined by the outlet opening 126*b* of the nozzle 126.

In a working embodiment, the orifices were selected, in conjunction with the 5 kilowatt rating of the heater 122, presuming that cold air ejected from an actuator would be at approximately 100° F. and hot air ejected from an actuator when the heater is activated at 100% would be at approximately 750° F. Noting that air at 100° F. is approximately twice the density of air at 750° F. then the air orifices are selected such that when cooling, the air flow is approximately 50 standard cubic feet per minute (SCFM) which, at approximately 100° F., is equal to approximately 50 actual cubic feet per minute (ACFM); and, when heating, the air flow is approximately 25 SCFM which, at approximately 750° F., is equal to approximately 50 actual cubic feet per minute (ACFM). Thus, since the temperatures attained by the 5 kilowatt heater 122 produce approximately a 2:1 ratio in air density, then the air orifices are also set to produce a 2:1 ratio in terms of air flow in SCFM. Of course, other temperatures could be used in the present invention and would produce differing air density ratios which would in turn dictate different air orifice ratios to match the air density ratios.

Energy is conserved by the actuators of the present application by an effective expansion of the control range of the actuators at the cooling end of their operation. This expanded range is due to the increased cool air flow such that it is substantially equal to the hot air flow. By setting the valve within the housing 116 such that the inlet opening 126*a* of the discharge nozzle 126 is substantially closed with less than 50% of maximum power provided to the heater 122, the operating range is ensured to be expanded. It is currently preferred to substantially close the inlet opening 126*a* of the discharge nozzle 126 whenever 30% or more of maximum power is provided to the heater 122.

Figure 9:
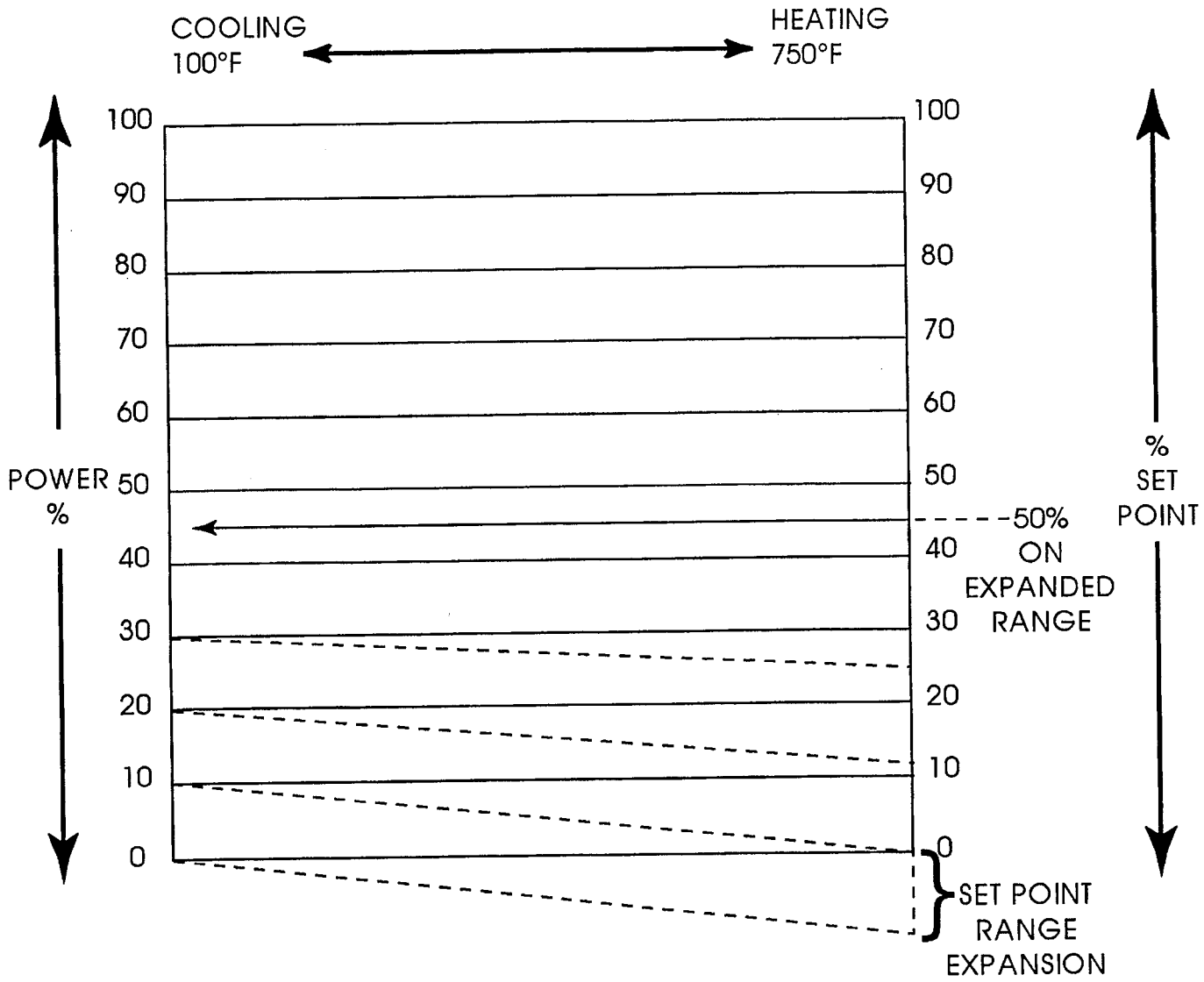
FIG. 9 is a chart illustrating energy saving in accordance with the present invention.

The expansion of the set point range which can be controlled utilizing actuators of the present application and thereby reduction in average power consumption is illustrated in FIG. 9. Cooling is improved by increasing the cooling air velocity over what would be provided if the same air orifice used for hot air was used for cold air, i.e., the valve within the housing 116 is opened for cooling operation. As illustrated in FIG. 9, the valve opens at approximately 30% of maximum heater power such that the cooling is expanded below this point. The expanded cooling capacity is illustrated by the downwardly sloping dotted lines in FIG. 9 which results in the expanded range for set point control. Since the calender roll controller 100 is normally operated around the 50% set point, it can be seen that the average power consumed by the controller 100 is reduced with operation on the expanded scale.

The scoop 108 illustrated in FIGS. 1, 2 and 4 improves operation of the actuators of the present application by substantially reducing heat loss out the back of the scoop 108 via the convex outer face 114. To prevent this heat loss, the scoop 108 comprises heat insulating material 170 to insulate the inner face 112 from the outer face 114. In addition, an inner layer of the inner face 112 comprises a plurality of arcuate zone strips 172 corresponding to the actuators, such as the actuators 102, 104, 106, which define the plurality of longitudinal zones for the calender roll 101. The strips 172 are substantially aligned with the actuators and are formed of metal bands which are secured in any appropriate manner to the inner face 112 of the scoop 108. The strips 172 direct air from the actuators along the scoop 108 and are separated from one another, for insulation purposes, to reduce thermal coupling between individual ones of the zone strips 172.

Having thus described the invention of the present application in detail and by reference to preferred embodiments thereof, it will be apparent that modifications and variations are possible without departing from the scope of the invention defined in the appended claims.

What is claimed is:

1. An actuator for controlling one longitudinal zone of a calender roll, said actuator being connected between a pressurized air plenum and said one longitudinal zone which is to be controlled by said actuator which comprises:

an air conducting housing having a proximal end connected to and in communication with said plenum for receiving air from said plenum and a distal end for discharging air from an air outlet of said housing at said one longitudinal zone;

a heater connected within said housing for passing air from said proximal end of said housing toward said distal end of said housing; and a valve connected within said housing for controlling the volume of air discharged at said one longitudinal zone in response to air temperature being discharged.

2. An actuator as claimed in claim 1 wherein said valve is connected within said housing between said heater and said distal end of said housing.

3. An actuator as claimed in claim 2 wherein said distal end of said housing comprises a discharge nozzle having an inlet opening and an outlet opening, and said valve is connected to control the size of the inlet opening of said discharge nozzle.

4. An actuator as claimed in claim 3 wherein said valve comprises a thermostatic metal panel which is secured within said housing for movement between a first position wherein said inlet opening of said discharge nozzle is substantially open and a second position wherein said inlet opening of said discharge nozzle is substantially closed.

5. An actuator as claimed in claim 4 wherein said panel is spaced from inside walls of said housing by a selected distance to define an air orifice within said housing when said inlet opening of said discharge nozzle is substantially closed.

6. An actuator as claimed in claim 4 wherein said panel is sized relative to said housing such that sufficient spacing is defined between said panel and inside walls of said housing to permit free movement of said panel within said housing, at least one aperture through said panel and said spacing between said panel and said inside walls of said housing defining an air orifice within said housing when said inlet opening of said discharge nozzle is substantially closed.

7. An actuator as claimed in claim 4 wherein said heater and said panel are selected to substantially close said inlet opening of said discharge nozzle with less than 50% of maximum power provided to said heater.

8. An actuator as claimed in claim 4 wherein said heater and said panel are selected to substantially close said inlet opening of said discharge nozzle with 30% or more of maximum power provided to said heater.

9. An actuator as claimed in claim 3 wherein said heater defines a first passage between said proximal end and said distal end of said housing and said housing comprises a second passage around said heater between said proximal end and said distal end of said housing, said second passage including a divider plate coupled to said inlet opening of said nozzle for continuously passing air from said second passage to said nozzle, said valve controlling the volume of air passing from said proximal end through said heater to said nozzle.

10. An actuator as claimed in claim 9 wherein said valve comprises:

a thermostatic metal panel which is secured within said housing for movement on a first side of said divider plate within said second passage;

a valve panel which is secured within said housing for movement on a second side of said divider plate between a first position wherein said inlet opening of said discharge nozzle is substantially open and a second position wherein said inlet opening of said discharge nozzle is substantially closed; and at least one link element connected between said thermostatic metal panel and said valve panel through at least one aperture in said divider plate such that movement of said valve panel is controlled by movement of said thermostatic metal panel.

11. An actuator as claimed in claim 10 wherein said heater, said thermostatic metal panel and said valve panel are selected to substantially close said inlet opening of said discharge nozzle with less than 50% of maximum power provided to said heater.

12. An actuator as claimed in claim 10 wherein said heater, said thermostatic metal panel and said valve panel are selected to substantially close said inlet opening of said discharge nozzle with 30% or more of maximum power provided to said heater.

13. A controller for a calender roll with a plurality of longitudinal zones therealong, said controller comprising:

a plurality of actuators corresponding to said plurality of longitudinal zones and being connected between a pressurized plenum and said calender roll, each of said actuators comprising:

an air conducting housing having a proximal end connected to and in communication with said plenum for receiving air from said plenum and a distal end for discharging air from an air outlet of said housing;

a heater connected within said housing for passing air from said proximal end of said housing toward said distal end of said housing; and a valve connected within said housing for controlling the volume of air discharged at said air outlet in response to air temperature being discharged; and an arcuate scoop extending from the distal ends of said plurality of actuators, said scoop being positioned adjacent and spaced from said calender roll and being substantially concentric therewith for defining an arcuate channel for receiving air from the air outlets of said plurality of actuators, said arcuate scoop having an inner face adjacent said calender roll and an outer face.

14. A controller for a calender roll as claimed in claim 13 wherein said arcuate scoop comprises heat insulating material to insulate said inner face from said outer face.

15. A controller for a calender roll as claimed in claim 14 wherein said insulating material of said arcuate scoop comprises an inner face layer thereof which further comprises a plurality of arcuate zone strips corresponding to said plurality of longitudinal zones and being substantially aligned with said plurality of actuators, said plurality of arcuate zone strips being formed of metal bands which are secured to said inner face layer and insulated from one another for conducting air from said plurality of actuators along said scoop with reduced thermal coupling between individual ones of said zone strips and between said zone strips and said outer face.

16. A controller for a calender roll as claimed in claim 15 wherein said valve is connected within said housing between said heater and said distal end of said housing.

17. A controller for a calender roll as claimed in claim 16 wherein said distal end of said housing of each of said plurality of actuators comprises a discharge nozzle having an inlet opening and an outlet opening, and said valve of each of said plurality of actuators is connected to control the size of the inlet opening of said discharge nozzle.

18. A controller for a calender roll as claimed in claim 17 wherein said valve of each of said plurality of actuators comprises a thermostatic metal panel which is secured within said housing for movement between a first position wherein said inlet opening of said discharge nozzle is substantially open and a second position wherein said inlet opening of said discharge nozzle is substantially closed.

19. A method for controlling an actuator for one longitudinal zone of a calender roll, said method comprising the steps of:

providing a source of pressurized air;

coupling an actuator to said source of pressurized air;

passing air from said pressurized source through a heater;

operating said heater to control air temperature;

directing air from said heater through a discharge nozzle onto said one longitudinal zone of said calender roll; and controlling the volume of air discharged through said discharge nozzle in response to air temperature being discharged.

20. A method for controlling an actuator for one longitudinal zone of a calender roll as claimed in claim 19 wherein the step of controlling the volume of air discharged through said discharge nozzle comprises the step of changing an air orifice defined by an inlet opening of said discharge nozzle in response to air temperature being discharged.

21. A method for controlling an actuator for one longitudinal zone of a calender roll as claimed in claim 20 wherein said step of changing an air orifice defined by an inlet opening of said discharge nozzle in response to air temperature being discharged comprises the step of providing a thermostatic metal panel which responds to air temperature by closing said inlet opening of said discharge nozzle as air temperature increases and by opening said inlet opening of said discharge nozzle as air temperature decreases.

22. A method for controlling an actuator for one longitudinal zone of a calender roll as claimed in claim 21 wherein said step of changing an air orifice defined by an inlet opening of said discharge nozzle in response to air temperature being discharged comprises the step of substantially closing said inlet opening at operating levels of said heater less than 50% maximum heating power.

23. A method for controlling an actuator for one longitudinal zone of a calender as claimed in claim 21 wherein said step of changing an air orifice defined by an inlet opening of said discharge nozzle in response to air temperature being discharged comprises the step of substantially closing said inlet opening at operating levels of said heater of approximately 30% or more of maximum heating power.

* * * * *